United States Patent [19]

Bampfield et al.

[11] Patent Number: 4,473,418

[45] Date of Patent: Sep. 25, 1984

[54] EMULSION EXPLOSIVE COMPOSITION

[75] Inventors: Howard A. Bampfield, Otterburn Park; Fortunato Villamagna, St Leonard, both of Canada; Jeremy G. B. Smith, Edenvale, South Africa

[73] Assignees: AECI Limited, Johannesburg, South Africa; C-I-L Inc., North York, Canada

[21] Appl. No.: 545,766

[22] Filed: Oct. 26, 1983

[30] Foreign Application Priority Data

Oct. 29, 1982 [GB] United Kingdom ..... 8230943

[51] Int. Cl.[3] ..... C06B 45/00

[52] U.S. Cl. ..... 149/2; 149/44; 149/46; 149/60; 149/61; 149/88; 149/92; 149/105

[58] Field of Search ..... 149/2, 46, 44, 60, 61, 149/92, 88, 105

[56] References Cited

U.S. PATENT DOCUMENTS

| | | | |
|---|---|---|---|
| 4,149,917 | 4/1979 | Wade | 149/61 X |
| 4,218,272 | 8/1980 | Brockington | 149/2 X |
| 4,248,644 | 2/1981 | Healy | 149/61 X |
| 4,357,184 | 11/1982 | Binet et al. | 149/61 X |
| 4,383,873 | 5/1983 | Wade et al. | 149/61 X |
| 4,391,659 | 7/1983 | Smith | 149/61 X |

*Primary Examiner*—Stephen J. Lechert, Jr.
*Attorney, Agent, or Firm*—Donald G. Ballantyne

[57] ABSTRACT

An emulsion explosive composition comprising an oxygen-supplying salt component as a discontinuous phase, an organic medium forming a continuous phase and an emulsifying agent which comprises at least one conventional emulsifier and at least one emulsification enhancer. The compositions are easily emulsifiable.

10 Claims, No Drawings

EMULSION EXPLOSIVE COMPOSITION

This invention relates to an explosive composition and, in particular, to an emulsion explosive composition of the kind comprising a discontinuous oxidiser phase dispersed throughout a continuous fuel phase which is substantially immiscible with the discontinuous phase.

Commercially available emulsion explosive compositions generally comprise an external or continuous organic fuel phase in which discrete droplets of an aqueous solution of an oxygen-supplying source are dispersed as an internal or discontinuous phase. Such compositions are conventionally described as water-in-oil emulsion explosive compositions, and examples thereof have been described, inter alia, in U.S. Pat. Nos. 3,447,978, 3,674,578, 3,770,522, 4,104,092, 4,111,727, 4,149,916 and 4,149,917.

For certain applications the water content of the oxidiser phase of the emulsion explosive may be completely eliminated or at least reduced to a low level - for example, to less than 4% by weight of the total emulsion composition. Such compositions are conventionally referred to as melt-in-oil or melt-in-fuel emulsion explosives and have been described, inter alia, in U.S. Pat. No. 4,248,644.

The term "emulsion explosive composition" is hereinafter employed to embrace compositions of both the water-in-oil(fuel) and melt-in-oil(fuel) types.

Emulsion explosive compositions may be manufactured for a variety of blasting applications and may vary in form from a cap-sensitive composition detonable in small diameter charges to a cap-insensitive composition intended for detonation only by boostering in large diameter charges. Such compositions may be produced either continuously or batchwise using a variety of medium-to-high shear mixing apparatus, homogenisers, in-line motionless mixers, and the like, which mixers effect a distribution in the continuous phase of fine oxidiser phase droplets having a typical size range of from about 1 to 10 microns (μm). In order to achieve such fine droplet distribution the inclusion of a suitable emulsifier in the mixture is deemed essential. The emulsifier is selected to promote a subdivision of the droplets of the oxidiser phase and dispersion thereof in the continuous phase. In addition, the emulsifier is believed to exist as a molecular coating layer on the surface of the droplets thereby to reduce incipient breakdown of the emulsion by inhibiting coalescence and agglomeration of the droplets.

In the related field of aqueous slurry explosives manufacture and use, a technique wherein on-site manufacture of the final product at the point of use is now well known. Such a technique and the apparatus employed therein is disclosed, for example, in U.S. Pat. Nos. 3,303,738 and 3,380,333. In such a process predetermined flows of the components of a slurry explosive are delivered to a truck-mounted vortex type mixing unit where they are combined and immediately thereafter delivered by hose or funnel into a nearby borehole. The on-site preparation of emulsion explosive compositions may be undertaken in a similar manner employing a substantially equivalent vehicle-mounted mixing apparatus. In such an application, an oxidiser salt phase from one reservoir and an oil/emulsifier phase from another reservoir are fed in a predetermined ratio and flow rate to a vortex mixer and thence immediately to the borehole. If the composition is inadequately emulsified or if the droplet size is large or widely distributed, the resulting product will lack stability and may have no utility as an explosive. While some control of the emulsion quality can be exercised through optimum mixer design or configuration and by careful regulation of feed rates of the oxidiser and oil phases, the success of such a manufacturing process is critically dependent on the ease or facility of the emulsification per se. The ease of emulsification is particularly critical in a onepass, continuous process at an on-site location since, unlike a batch process, prolonging the mixing period to achieve fine droplet distribution is not possible.

British patent specification GB No. 2 042 495A discloses a water-in-oil emulsion blasting composition having as the sole emulsifier an organic cationic emulsifier comprising a hydrophilic portion and a lipophilic portion, the latter being an unsaturated hydrocarbon chain. The unsaturated emulsifier may be a fatty acid amine or ammonium salt having a chain length of from 14 to 22 carbon atoms.

We have now devised an improved emulsification technique for the production of emulsion explosive compositions.

Accordingly, the present invention provides an emulsion explosive composition comprising an oxygen supplying salt component as a discontinuous phase, an organic medium forming a continuous phase and an emulsifying agent characterised in that the emulsifying agent comprises at least one conventional emulsifier and at least one emulsification enhancer.

The invention further provides a process for producing an emulsion explosive composition comprising emulsifying an oxygen-supplying salt component and an organic medium in the presence of an emulsifying agent to form an emulsion in which the salt forms at least part of the discontinuous phase and the organic medium forms at least part of the continuous phase characterised in that the emulsifying agent comprises at least one conventional emulsifier and at least one emulsification enhancer.

The oxygen-supplying salt component of the discontinuous phase suitably comprises any oxidiser salt capable of releasing oxygen in an explosive environment in an amount and at a rate sufficient to confer acceptable explosive characteristics on the emulsion composition. Inorganic oxidiser salts conventionally employed in the production of emulsion explosive compositions, and suitable for inclusion in the compositions of the present invention, are disclosed, for example, in U.S. Pat. No. 3,447,978 and include ammonium salts and salts of the alkali- and alkaline-earth metals—such as the nitrate, chlorate and perchlorate salts, and mixtures thereof. Other suitable salts include hydrazine nitrate and urea perchlorate.

Ammonium nitrate is preferably employed as a primary oxidiser salt comprising at least 50% by weight of the oxygen-supplying salt component, supplemented, if desired, by a minor (not exceeding 50% by weight) amount of a secondary oxidiser components, such as calcium nitrate or sodium nitrate. A secondary oxidiser component may be incorporated into an aqueous discontinuous phase but its presence is particularly desirable if the oxygen-supplying salt component is to be incorporated into the emulsion in the form of a melt, i.e. in the substantial or complete absence of water from the discontinuous phase. Suitable secondary oxidiser components which form an eutectic melt when heated together with ammonium nitrate include inorganic oxidiser salts of the kind hereinbefore described, such as the nitrates of lead, silver, sodium and calcium, and organic compounds, such as mono- and poly-hydroxylic compounds including methanol, ethylene glycol, glycerol, mannitol, sorbitol and pentaerythritol, carbohydrates, such as glucose, sucrose, fructose and maltose, aliphatic carboxylic acids and their derivatives, such as formic acid and formamide, and organo-nitrogen compounds, such as urea, methylamine nitrate and hexamethylene tetramine, and mixtures thereof.

The discontinuous phase may optionally comprise a solid oxidiser component, such as solid ammonium nitrate conveniently in the form of prills.

Typically, the discontinuous phase may comprise from about 20 to about 97%, more usually from 30 to 95%, and preferably from 70 to 95% weight of the total emulsion explosive composition. The discontinuous phase may be entirely devoid of water, in the case of a melt emulsion, or may comprise relatively minor amounts of water, for example—from 2 to 30%, more usually from 4 to 25% and preferably from 8 to 18% by weight of the total composition.

The organic medium capable of forming the continuous phase of an emulsion explosive composition in accordance with the invention serves as a fuel for the explosive composition and should be substantially insoluble in the component(s) of the discontinuous phase with which it should be capable of forming an emulsion in the presence of an effective amount of an appropriate emulsifying agent. Ease of emulsification depends, inter alia, on the viscosity of the organic medium, and although the resultant emulsion may have a substantially solid continuous phase, the organic medium should be capable of existing initially in a sufficiently fluid state, if necessary in response to appropriate temperature adjustment, to permit emulsification to proceed.

Suitable organic media which are capable of existing in the liquid state at convenient emulsion formulation temperatures include saturated and unsaturated aliphatic and aromatic hydrocarbons, and mixtures thereof. Preferred media include refined (white) mineral oil, diesel oil, paraffin oil, petroleum distillates, benzene, toluene, dinitrotoluene, styrene, xylenes, and mixtures thereof.

In addition to the organic fuel medium the continuous phase may, optionally, comprise a wax to control the rheology of the system. Suitable waxes include petroleum, mineral, animal, and insect waxes. The preferred waxes have melting temperatures of at least 30° C. and are readily compatible with the formed emulsion. A preferred wax has a melting temperature in a range of from about 40° C. to 75° C.

Generally, the continuous phase (including wax(es), if present) comprises from 1 to 25, preferably from 2 to 20%, and particularly preferably from 3 to 12% by weight of the total explosive composition. Higher proportions, may be tolerated, if desired.

Formulation of a stable emulsion is generally effected in the presence of an emulsifier capable of promoting a relatively permanent dispersion of the discontinuous phase component(s) in the continuous phase medium. Emulsifiers hitherto employed in the production of emulsion explosive compositions have conventionally been of the water(or melt)-in-oil type which promote or facilitate the formation of an emulsion in which the discontinuous phase comprises an aqueous (or melt) medium and the continuous phase comprises an oily or organic medium. Such emulsifiers are herein described as conventional emulsifiers.

Conventional emulsifiers, as hereinbefore defined, are strongly lipophilic, i.e. they exhibit a high affinity for the oily or organic medium of the continuous phase, and have a low hydrophilic-lipophilic balance (HLB). Typically, such conventional emulsifiers have HLB values of less than about 10, and particularly from about 2 to 6.

Many suitable conventional emulsifiers have been described in detail in the literature and include, for example, sorbitan esters, such as sorbitan sesquioleate, sorbitan monooleate, sorbitan monopalmitate, sorbitan monostearate and sorbitan tristearate, the mono- and diglycerides of fat-forming fatty acids, soyabean lecithin and derivatives of lanolin, such as isopropyl esters of lanolin fatty acids, mixtures of higher molecular weight fatty alcohols and wax esters, ethoxylated fatty ethers, such as polyoxyethylene (4) lauryl ether, polyoxyethylene(2) oleyl ether, polyoxyethylene(2) stearyl ether, polyoxyalkylene oleyl laurate, substituted oxazolines, such as 2-oleyl-4,4'-bis(hydroxymethyl)-2-oxazoline, and polymeric emulsifiers, such as alkyds, ethylene oxide/propylene oxide copolymers and hydrophobe/hydrophil block copolymers. Suitable mixtures of such conventional emulsifiers may also be selected for use.

Although intended for use in the production of a water (or melt)-in-fuel type emulsion explosive composition, the emulsification enhancer component (hereinafter described as the enhancer) of the emulsifying agent is, to a degree, required to function as a fuel-in-water(or melt) emulsifier - i.e. an emulsifier which promotes or facilitates the formation of an emulsion in which the discontinuous phase is an oily or organic liquid phase, and in which the continuous phase is an aqueous or melt phase. The enhancer should therefore be strongly hydrophilic, i.e. exhibit a high affinity for the oxidiser phase, and have a high hydrophilic-lipophilic balance (HLB). Typically, an enhancer will have an HLB value of greater than 10.

The conventional emulsifier and enhancer, when combined together as by mixing, desirably should have an HLB value not exceeding a predetermined upper value, in the region of about 10. The reason for this is that, if the combined emulsifier and enhancer have an HLB value exceeding this critical value, they will tend to promote the formation of an oil-in-water type emulsion, and the emulsion properties of the emulsion explosive product, being a water- or melt-in-oil type emulsion, can be completely destroyed. This thus sets the upper limit of the HLB value of the combined emulsifier and enhancer, and also generally sets the upper limit of the proportion of enhancer which can be used.

Suitable enhancers include disodium alkyl diphenyl either disulphonates having the formula:

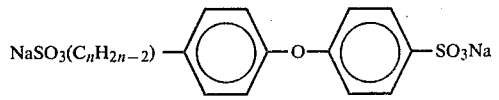

in which n is from about 10 to 22, e.g. disodium dodecyl diphenyl ether disulphonate, in which n is 12, the alkyl group preferably being a straight chain or normal (unbranched) chain, and containing one double bond, and the derivative of sodium sulphosuccinic acid having the formula:

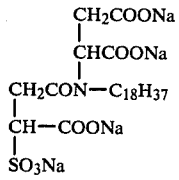

Acceptable ease of emulsification is achieved when the emulsifying agent comprises a major proportion (>50 wt % of the total emulsifying agent) of the conventional emulsifier and a minor proportion (<50 wt % of the total emulsifying agent) of the enhancer. Desirably, the weight ratio of conventional emulsifier to enhancer in the emulsifying agent should be from 1000:1 to 1:1, preferably from 700:1 to 2:1, and particularly preferably from 500:1 to 100:1.

Generally, acceptable ease of emulsification is achieved when the emulsifying agent (conventional plus enhancer) comprises from 0.1 to 5, preferably from 0.2 to 4, and particularly preferably from 0.5 to 2.5% by weight of the total explosive composition. Higher proportions of emulsifying agent may be tolerated, excess emulsifying agent serving as a supplemental fuel for the composition, but, in general, economic considerations dictate that the amount of emulsifying agent be kept to a minimum commensurate with acceptable performance.

In a preferred embodiment of the invention, which improves ease of emulsification and confers enhanced stability on the resultant explosive composition, the enhancer comprises an organic emulsifier having a hydrophilic portion and a lipophilic portion, and exhibiting a high solubility in water or in aqueous salt solutions and a high tolerance to salt. Such water soluble and salt tolerant enhancers may be anionic, cationic or nonionic in nature and desirably, comprise a lipophilic portion having a chain length of at least 8 carbon atoms. By high tolerance to salt is meant that the enhancer maintains its function in the presence of aqueous salt solutions which is reflected by the lowering of the surface tension of a 10% aqueous sodium sulphate solution at a temperature of 30° C. By high water solubility is meant that at least 10% by weight of the enhancer is soluble in water at a temperature of 30° C. When this particular selection of enhancers is employed in very small quantities in a mixture with at least one conventional emulsifier, a surprising and unexpected improvement in the rate of emulsification of water (or melt)-in-oil emulsion explosive compositions can be achieved.

A preferred emulsion explosive composition therefore comprises an external continuous oil/fuel phase and a discontinuous oxidiser salt phase and from 0.5% to 4% by weight of the total composition of an emulsifying agent characterised in that the emulsifying agent comprises at least one conventional emulsifier and an emulsification enhancer (preferably in an amount of from 0.005% to 0.05% by weight of the total composition) which is an organic emulsifier comprising a hydrophilic portion and a lipophilic portion, the said lipophilic portion comprising a chain (preferably unsaturated) of at least 8 carbon atoms, the said organic emulsification enhancer having a solubility in water at a temperature of 30° C. of at least 10% by weight and being capable of lowering the surface tension of a 10 wt % aqueous sodium sulphate solution at a temperature of 30° C.

Desirably, the water soluble and salt tolerant emulsification enhancers, should be employed in relatively small amounts. Thus, such an enhancer should not be employed in an amount in excess of that (generally of the order of 0.05% by weight of the total emulsion composition) observed to provide positive enhancement of the emulsification process as in some instances it may actually function as an emulsion breaker at higher concentrations.

The emulsifying agent may be formulated by preblending the conventional emulsifier and enhancer prior to incorporating the emulsifying agent into the emulsification medium, or, if desired, the conventional emulsifier and the enhancer may be independently introduced into the medium. Desirably, at least the enhancer should be dissolved or well dispersed in the oil (fuel) phase before mixing with the oxidiser phase, although, depending on the properties of the selected enhancer, it may be introduced into the oxidiser phase before the latter is incorporated into the oil (fuel) phase.

If desired, additional components may be incorporated into the compositions of the present invention. For example, supplementary fuel components may be included. Typical supplementary fuel components suitable for incorporation into the discontinuous phase include soluble carbohydrate materials, such as glucose, sucrose, fructose, maltose and molasses, lower glycols, formamide, urea, methylamine nitrate, hexamethylene tetramide, hexamethylene tetramine nitrate, and other organic nitrates.

Supplementary fuel components which may be incorporated into the continuous phase include fatty acids, higher alcohols, vegetable oils, aliphatic and aromatic nitro organic compounds, such as dinitrotoluene, nitrate esters, and solid particulate materials such as coal, graphite, carbon, sulphur, aluminium and magnesium.

Combinations of the hereinbefore described supplementary fuel components may be employed, if desired.

The amount of supplementary fuel component(s) employed may be varied in accordance with the required characteristics of the compositions, but, in general, will be in a range of from 0 to 30, preferably from 5 to 25, % by weight of the total emulsion explosive composition.

Thickening and or cross-linking agents may be included in the compositions, if desired—generally in small amounts up to the order of 10, and preferably from 1 to 5, % by weight of the total explosive composition. Typical thickening agents include natural gums, such as guar gum or derivatives thereof, and synthetic polymers, particularly those derived from acrylamide.

Minor amounts of non-volatile, water insoluble polymeric or elastomeric materials, such as natural rubber, synthetic rubber and polyisobutylene may be incorporated into the continuous phase. Suitable polymeric additives include butadiene-styrene, isoprene-isobutylene, or isobutylene-ethylene copolymers. Terpolymers thereof may also be employed to modify the continuous phase, and in particular to improve the retention of occluded gases in the compositions.

Preferably, the emulsion explosive compositions of the present invention comprise a discontinuous gaseous component to reduce their density (to less than 1.5, and preferably to from about 0.8 to about 1.4 gm/cc) and enhance their sensitivity. The gaseous component, usually air, may be incorporated into the compositions of the present invention as fine gas bubbles dispersed throughout the composition, hollow particles which are often referred to as microballoons or microspheres, porous particles, or mixtures thereof. A discontinuous phase of fine gas bubbles may be incorporated into the compositions of the present invention by mechanical agitation, injection or bubbling the gas through the composition, or by chemical generation of the gas in situ. Suitable chemicals for the in situ generation of gas bubbles include peroxides, such as hydrogen peroxide, nitrites, such as sodium nitrite, nitrosoamines, such as N,N'-dinitrosopenta-methylenetetramine, alkali metal borohydrides, such as sodium borohydride, and carbonates, such as sodium carbonate. Preferred chemicals for the in situ generation of gas bubbles are nitrous acid and its salts which decompose under conditions of acid pH to produce gas bubbles. Thiourea may be used to accelerate the decomposition of a nitrite gassing agent. Suitable hollow particles include small hollow microspheres of glass and resinous materials, such as phenol-formaldehyde and urea-formaldehyde. Suitable porous materials include expanded minerals, such as perlite.

The gas component is usually added during cooling such that the prepared emulsion comprises from about 0.05 to 50% by volume of gas at ambient temperature and pressure. Conveniently the occluded gas is of bubble diameter below 200 μm, preferably below 100 μm, more preferably between 20 and 90 'μm and particularly between 40 and 70 μm, in proportions less than 50%, preferably between 40 and 3%, and particularly preferably between 30 and 10% by volume. Preferably at least 50% of the occluded gas will be in the form of bubbles or microspheres of 20 to 90 μm, preferably 40 to 70 μm internal diameter.

An emulsion explosive composition according to the present invention may be prepared by conventional emulsification techniques. Thus, the oxygen-supplying salt(s) may be dissolved in the aqueous phase at a temperature above the fudge point of the salt solution, preferably at a temperature in the range of from 25 to 110° C., and a mixture, preferably a solution, of the emulsifying agent and organic phase is separately prepared, preferably at the same temperature as the salt solution. The aqueous phase is then added to the organic phase with rapid mixing to produce the emulsion explosive composition, mixing being continued until the formation is uniform. Optional solid and or gaseous components may then be introduced with further agitation until a homogeneous emulsion is obtained.

An emulsion explosive composition according to the invention may be used as such, or may be packaged into charges of appropriate dimensions.

The invention is illustrated by reference to the following Examples in which all parts and percentages are expressed on a weight basis unless otherwise stated.

EXAMPLE 1—CONTROL 18 parts by weight of Glycomul SOC (Reg TM), 18 parts by weight of soya lecithin and 6 parts of a polymeric surfactant were dissolved in 150 parts by weight of purified mineral oil at 40° C. and the resultant solution heated to 70° C. This hot solution was added to 2808 parts by weight of an 80% solution of ammonium nitrate at 70° C. in the bowl of a slow speed HOBART (Reg TM) mixer to produce an oil-in-water emulsion. The mixer was then run at high speed until the oil/water emulsion had inverted to a water/oil emulsion. This change is evidenced by a change in viscosity and by an oily appearance to the product. This inversion took place 3.58 minutes after starting the mixer.

EXAMPLE 2

The procedure of Example 1 was repeated save that 0.3 part of sodium disopropyl naphthalene sulphonate enhancer was added to the oil solution and thoroughly mixed for several minutes at 60° C. before this solution was added to the aqueous liquor. In this case, the emulsion took 1.62 minutes to invert under the same conditions.

EXAMPLE 3

To demonstrate that "inversion time" is a practical measure of ease of emulsification, an examination was made of the droplet size as a function of time. It was demonstrated that the useful water soluble and melt tolerant enhancers of the present invention produced an emulsion composition having smaller droplet size which droplet size is directly related to "inversion time".

6.4 parts by weight of an oil phase (5 parts oil, 0.6 parts GLYCOMUL, 0.6 parts lecithin, 0.2 parts polymeric surfactant) were placed in the bowl of a HOBART (Reg TM) mixer and the mixer started at its slowest agitation speed. 93.6 parts by weight of a salt solution phase (80% ammonium nitrate, 20% water) were added to the mixer over a period of two minutes and mixing thereafter continued for a period up to 5 minutes. The resulting emulsion was examined under a microscope after 1 and 5 minutes of mixing and the average droplet size noted. This result is shown under entry (1) in Table I below. The test was repeated with the addition to the mixture of 0.01 part by weight of the respective emulsification enhancers shown under entries (2) and (3) in Table I. A further test was undertaken employing 0.01 part by weight of a conventional emulsifier different from the emulsification enhancers of the invention. This result is shown under entry (4) in Table I.

TABLE I

| | Emulsification enhancer added (0.01 part) | Inversion time (mins.) | Droplet size after 1 min. (μm) | Droplet size after 5 min. (μm) |
|---|---|---|---|---|
| (1) | Nil | 3.5 | 19 | 7.1 |
| (2) | Sodium diisopropyl-naphthalene sulphonate | 1.62 | 8.4 | 4.0 |
| (3) | Sodium ditridecyl sulfosuccinate | 2.01 | 9.3 | 4.8 |
| (4) | Dioctyl sodium sulfosuccinate | 4.2, 3.9 | 11.6 | 9.3 |

EXAMPLES 4 to 10

A water-in-oil emulsion explosive composition was prepared which consisted of 91.1% by weight of an aqueous oxidiser salt phase (64.8% ammonium nitrate, 19.7% sodium nitrate, 15.15% water), 6.5% by weight oil/fuel phase (3.75% paraffin oil, 2.75% paraffin wax) and 1.75% by weight mixed conventional emulsifiers (0.75% GLYCOMUL SOC, Reg TM, 0.75% lecithin, 0.25% polymeric surfactant). To each of seven samples of the composition were added 0.01% by weight of the defined organic emulsion enhancers or wetting agents of the invention.

The results are tabulated in Table II.

TABLE II

| Ex. | Emulsion enhancer (0.01%) | Inversion[2] time (minutes) | Water solubility g/100 ml[3] | Salt tolerance[1] |
|---|---|---|---|---|
| 4 | Sodium diamyl sulfosuccinate | 1.84 | 40 | Excellent |
| 5 | Sodium dioctyl sulfosuccinate | 3.33 | 1.15 | Poor |
| 6 | Sodium dihexyl sulfosuccinate | 2.1 | 34 | Fair |
| 7 | Polyethylene glycol monolaurate | Prevents inversion | <3 | Poor |
| 8 | Nonyl phenol ethoxylate (HLB 6) | Prevents inversion | >50 | Poor |
| 9 | Cocoamine | 2.13 | Slight[4] | Poor |
| 10 | Tetrasodium N (1,2-dicarboxethyl) N—octadecyl sulfosuccinimate | 1.29 | | Excellent |

[1]Excellent - soluble and lowers surface tension in at least 15% sodium sulfate
Good - soluble and lowers surface tension in at least 10% sodium sulfate
Fair - soluble and lowers surface tension in at least 5% sodium sulfate
Poor - intolerant to 5% sodium sulfate
[2]Time required to change from oil-in-water to water-in-oil emulsion Without enhancer the inversion time is 2.12 minutes
[3]At 30° C.
[4]This material present as its nitrate salt which solubility in water is slightly higher. Salt tolerance is with reference to sodium nitrate rather than sodium sulphate.

From the results shown in Table II it is seen that in Examples 4 and 10, where the emulsion enhancer used had both high water solubility and good salt tolerance, the inversion time was substantially better than in Examples 5 to 9.

EXAMPLES 11 to 22

A water-in-oil emulsion explosive composition was prepared which consisted of 93.6% by weight of an aqueous salt solution phase (80% ammonium nitrate, 20% water), 5.0% by weight of paraffin oil phase and 1.4% by weight of mixed conventional emulsifiers (0.6% GLYCOMUL SOC, Reg TM, 0.6% lecithin, 0.2% polymeric surfactant). To each of 12 samples of the composition were added 0.01% by weight of the defined emulsion enhancers or wetting agents of the invention. The results are tabulated in Table III.

TABLE III

| Ex. | Emulsion enhancer (0.01%) | Inversion[2] time (minutes) | Water solubility g/100 | Salt tolerance[1] |
|---|---|---|---|---|
| 11 | Disodium N—octadecyl sulfosuccinimate | 2.02 | 18 at 40° C. | Excellent at 40° C. |
| 12 | Sodium dioctyl sulfosuccinate | 4.18, 3.94 | 1.5 | Poor |
| 13 | Sodium dicyclohexyl sulfosuccinate | 3.6 | 34 | Fair |
| 14 | Ethoxylated alkyl guanidine (Aerosol C-61 Reg TM) | 2.02 | >20[4] | Good[4] |
| 15 | Sodium diisopropylnaphthalene sulfonate | 1.62 | >20 | Excellent |
| 16 | Disodium N—octadecyl sulfosuccinamate | 2.0 | 18 at 40° C. | Excellent at 40° C. |
| 17 | Aerosol A102 (disodium ethoxylated alcohol half ester of sulfosuccinic acid) | 1.77 | | Good |
| 18 | Aerosol A103 (disodium ethoxylated nonyl phenol half ester of sulfosuccinic acid) | 2.50 | | Good |
| 19 | Tetrasodium N (1.2 dicarboxyethyl) N—octadecyl sulfosuccinimate | 3.1, 3.28 | | Excellent |
| 20 | Sodium methyl naphthalene sulfonate | 3.12 | >20 | Excellent |
| 21 | Monazoline T (Talloil hydroxyethyl imidazoline) | 3.68 | <<10 | Poor |
| 22 | Sodium dihexyl sulfosuccinate | 2.99 | 34 | Fair |

[1]As in Table II
[2]Time required to change from oil-in-water to water-in-oil emulsion Without enhancer the inversion time is 3.5 minutes
[3]At 30° C.
[4]As for Table II From the results in Table III it can be seen that the enhancers of the invention as employed in Examples 11, 14 to 20 and 22 produce inversion times superior to those materials having poor water solubility and salt tolerance.

EXAMPLE 23—CONTROL

A control water-in-fuel type explosive was prepared in accordance with the following formulation:

| Constituent | Mass % |
|---|---|
| Ammonium nitrate | 68.3 |
| Sodium nitrate | 13.6 |
| Water | 11.5 |
| SPAN 80 (sorbitan monooleate primary emulsifier available from Atlas oil & Chemical Co. (Pty) Ltd) | 2.6 |
| P95 oil (paraffinic hydrocarbon oil-(fuel) available from BP Southern Africa (Pty) Ltd) | 4.0 |

Attempts to form an emulsion from this mixture by means of a HOBART mixer with a wire whip operated at the speed of 139 rpm for extended periods, were unsuccessful.

EXAMPLE 24

Example 23 was repeated, except that a proportion of the SPAN 80 was replaced by DOWFAX 2A1 (disodium dodecyl diphenyl ether disulphonate secondary emulsifier available from Dow Chemical Company) so that the SPAN 80 made up 1.75% by mass of the mixture, the DOWFAX making up 0.85% by mass of the mixture.

A suitable emulsion explosive was formed easily on the HOBART mixer at 139 rpm within 12 minutes.

EXAMPLE 25

The procedure of Example 24 was repeated, except that the SPAN 80 formed 2.00% by mass of the mixture, the DOWFAX 2A1 forming 0.60% of the mixture. The emulsion was found to form as easily at the same speed and within the same period on the HOBART mixture as in the case of Example 2.

When tested, the explosives of Examples 24 and 25 appeared to suffer no adverse effects on detonation, and detonated as easily and as forcefully as an emulsion made from the constituents of Example 23, which could only be formed eventually on the HOBART mixer at the speed of 591 rpm after an extended period.

From the laboratory tests conducted, it appears that the explosives of Examples 24 and 25 show promise in being capable of formation under low shear conditions, and Applicants believe that it may be possible to form them, for bulk use, with low speed mixers such as concrete mixers, or the like. This renders them particularly suitable for bulk on-site applications, where their constituents can be transported in bulk, and mixed in bulk on site with truck-mounted concrete mixers or the like. They also appear to be promising for large scale factory production using static mixers or other low shear mixers.

EXAMPLE 26—CONTROL

An emulsion explosive composition was prepared in accordance with the following formulation:

| | Mass % |
|---|---|
| (a) Aqueous phase components | |
| Ammonium Nitrate | 62.25 |
| Sodium Nitrate | 15.0 |
| Calcium Nitrate | 3.7 |
| Water | 12.9 |
| (b) Oil phase components | |
| P95 oil | 2.65 |
| Sasol wax - medium congealing artificial paraffin wax - available from SASOL | 1.75 |
| (c) Emulsifier components | |
| Sorbitan sesquioleate | 0.625 |
| Soya lecithin | 0.625 |
| Polyester/ether/ester block copolymer surfactant | 0.25 |

Formation of an emulsion from this mixture by means of a HOBART mixer with a wire whip required the mixer to be operated at a speed of 591 rpm for a period of 10 minutes after addition of the aqueous phase components. This addition is effected at a HOBART mixer speed of 285 rpm over a time period of 2 minutes. Attempts to prepare an emulsion at lower mixer speeds were unsuccessful.

EXAMPLE 27

The procedure of Example 26 was repeated save that into the aqueous phase components was incorporated (with corresponding proportionate reduction in the amounts of the respective emulsifier components) an enhancer comprising 0.25 weight % of Aerosol 22 (Tetra sodium-N(1,2-dicarboxyethyl)-N-octadecylsulphosuccinamate).

From the mixture an emulsion explosive composition was easily formed on the HOBART mixer with a wire whip operating at the relatively low speed of 139 rpm for 12 minutes.

EXAMPLE 28

The procedure of Example 26 was repeated save that into the oil phase components was incorporated (with corresponding proportionate reduction in the amounts of the respective emulsifier components) an enhancer comprising 0.25 weight % of coco-diethanolamide.

An emulsion was again readily formed from the mixture using a HOBART mixer with a wire whip operating at a speed of 139 rpm for 12 minutes.

EXAMPLE 29—CONTROL

An emulsion explosive composition was prepared in accordance with the following formulation:

| | Mass % |
|---|---|
| (a) Aqueous phase components | |
| Ammonium Nitrate | 62.25 |
| Sodium Nitrate | 15.0 |
| Calcium Nitrate | 3.7 |
| Water | 12.9 |
| (b) Oil phase components | |
| P95 oil | 2.65 |
| Sasol wax | 1.75 |
| (c) Emulsifier components | |
| Sorbitan sesquioleate | 0.75 |
| Soya lecithin | 0.75 |

Formation of an emulsion from this mixture by means of a HOBART mixer with a wire whip required the mixer to be operated at a speed of 591 rpm for a period of 10 minutes after addition of the aqueous phase components. This addition is effected at a HOBART mixer speed of 285 rpm over a time period of 2 minutes. Attempts to prepare an emulsion at lower mixer speeds were unsuccessful.

EXAMPLES 30 TO 32

The procedure of Example 29 was repeated save that into the oil phase components of each formulation was incorporated (with corresponding proportionate reduction in the amounts of the respective emulsifier components) 0.25 weight % of enhancer comprising the respective oleophilic natural petroleum sulphonate derivatives (available from Carst & Walker (Pty) Ltd, and manufactured by Witco Chemical Corporation) listed below:

| Example | Enhancer |
|---|---|
| 30 | Petronate L |
| 31 | Petronate HL |
| 32 | Petronate CR |

From each mixture an emulsion explosive composition was easily formed on the HOBART mixer with a wire whip operating at a speed of 139 rpm for 12 minutes.

EXAMPLE 33

The procedure of Example 29 was repeated save that into the aqueous phase components of the formulation was incorporated (with corresponding proportionate reduction in the amounts of the respective emulsifier components) 0.25 weight % of sodium lauryl sulphate as an enhancer.

An emulsion was easily formed from the mixture using a HOBART mixer with a wire whip operating at a speed of 139 rpm for 12 minutes.

We claim:

1. An emulsion explosive composition comprising an oxygen-supplying salt component as a discontinuous phase, an organic medium forming a continuous phase and an emulsifying agent wherein the emulsiying agent comprises at least one conventional emulsifier and at least one emulsification enhancer, the said emulsification enhancer is highly soluble in water or in aqueous salt solution, exhibits a high tolerance to salt and has a high hydrophilic-lipophilic balance (HLB), preferably greater than 10.

2. A composition according to claim 1 wherein the conventional emulsifier has a low hydrophilic-lipophilic balance (HLB), preferably less than 10.

3. A composition according to claim 1 wherein the conventional emulsifier and emulsification enhancer together exhibit an HLB not exceeding 10.

4. A composition according to claim 1 wherein the emulsifying agent comprises a major amount of the conventional emulsifier and a minor amount of the emulsification enhancer.

5. A composition according to claim 4 wherein the weight ratio of conventional emulsifier to emulsification enhancer in the emulsifying agent is from 1000:1 to 1:1.

6. A composition according to claim 1 wherein the emulsifying agent constitutes from 0.5 to 4.0% by weight of the composition and comprises at least one conventional emulsifier and an emulsification enhancer which is an organic emulsifier comprising a hydrophilic portion and a lipophilic portion, the said lipophilic portion comprising a chain (preferably unsaturated) of at least 8 carbon atoms, the said organic emulsification enhancer having a solubility in water at a temperature of 30° C. of at least 10% by weight and being capable of lowering the surface tension of a 10 wt % aqueous sodium sulphate solution at a temperature of 30° C.

7. A composition according to claim 1 wherein the enhancer comprises from 0.005% to 0.05% by weight of the total composition.

8. A process for producing an emulsion explosive composition comprising emulsifying an oxygen-supplying salt component and an organic medium in the presence of an emulsifying agent to form an emulsion in which the salt forms at least part of the discontinuous phase and the organic medium forms at least part of the continuous phase wherein the emulsifying agent comprises at least one conventional emulsifier and at least one emulsification enhancer.

9. A process according to claim 8 wherein the emulsification enhancer is highly soluble in water or in aqueous salt solution and exhibits a high tolerance to salt.

10. A process according to claim 8 wherein at least the emulsification enhancer is dissolved or dispersed in the organic medium prior to mixing of the organic medium with the salt component.

* * * * *